United States Patent [19]

Luchi et al.

[11] Patent Number: 4,541,253

[45] Date of Patent: Sep. 17, 1985

[54] PROCEDURE FOR PROCESSING WITH CIRCULAR KNITTING MACHINES AND CIRCULAR MACHINES ADOPTING SAID PROCEDURE

[75] Inventors: Luciano Luchi, Tavernuzze Impruneta; Ettore Negri, Florence, both of Italy

[73] Assignee: Officine Savio Spa, Pordenone, Italy

[21] Appl. No.: 415,461

[22] Filed: Sep. 7, 1982

[30] Foreign Application Priority Data

Sep. 10, 1981 [IT] Italy ..... 83463 A/81

[51] Int. Cl.[4] ..... D04B 9/10; D04B 9/20; D04B 9/38; D04B 15/68

[52] U.S. Cl. ..... 66/14; 66/51; 66/222

[58] Field of Search ..... 66/14, 46, 51, 222, 66/224, 226

[56] References Cited

U.S. PATENT DOCUMENTS

| | | | |
|---|---|---|---|
| 2,259,897 | 10/1941 | Lawson | 66/222 |
| 2,979,927 | 4/1961 | Wakefield | 66/14 |
| 2,987,898 | 6/1961 | Ferraguti | 66/14 |
| 3,678,710 | 7/1972 | Gostelow | 66/222 X |
| 3,890,804 | 6/1975 | Anglada | 66/222 X |

FOREIGN PATENT DOCUMENTS

| | | | |
|---|---|---|---|
| 1065126 | 9/1959 | Fed. Rep. of Germany | 66/224 |
| 2716395 | 11/1977 | Fed. Rep. of Germany | 66/14 |
| 2735492 | 2/1978 | France | 66/222 |
| 42139 | 12/1969 | German Democratic Rep. | 66/222 |
| 552746 | 4/1943 | United Kingdom | 66/51 |
| 2062021 | 5/1981 | United Kingdom | 66/224 |

*Primary Examiner*—Wm. Carter Reynolds

*Attorney, Agent, or Firm*—Stevens, Davis, Miller & Mosher

[57] ABSTRACT

Procedure for knitting hose with a toe and heel in a circular knitting machine having more than one feed and two needle cylinders. All needles are brought to an upper path during knitting of the toe and heel with alternating motion, and at every oscillation of the cylinder those needles alone which have been selected to knit the course relative to the oscillation are brought back to work from the upper path towards a lower working path. The selection of needles is brought about by cooperation between fixed radial cams situated so as to correspond with the main feed and appropriate selection actuators. The selection for jacquard designs takes place upwardly from the lower path to the upper path by cooperation between appropriate selection actuators and movable radial cams located so as to correspond with each feed. The upper path serves to exclude the needles of the lower cylinder from work and also to protect the upper cylinder needles, the lower path being the path for jacquard designs. The apparatus relates to a circular knitting machine which has more than one feed and a double cylinder.

8 Claims, 6 Drawing Figures

• NEEDLES IN WORK
○ NEEDLES OUT OF WORK

SENSE OF ROTATION

PROCEDURE FOR PROCESSING WITH CIRCULAR KNITTING MACHINES AND CIRCULAR MACHINES ADOPTING SAID PROCEDURE

This invention relates to a procedure for processing with circular knitting machines and also a circular machine adopting the procedure.

To be more exact, the invention relates to a procedure and a circular machine with one or more feeds for processing stockings and socks with purl or rib stitches or jacquard designs and with their heel or toe knitted with alternating motion.

Machines of the known art comprise jackets wherein working paths and exclusion paths are connected together with intermediate paths, whereby all of the paths act as guides for the sliding of the needles or needle-sliders and various fixed and movable cams serve to carry out the various maneuvers of the needles and the respective needle-sliders.

Known machines are equipped with switching elements or pickers for transferring the needles or needle-sliders from one path to another.

In some systems the switching elements or pickers cooperate with intermediate fingers included in the cylinder of the circular machine.

The guide paths along which the fingers, disengaged from their respective needle-sliders, can run are called memory paths.

In particular, the memory paths enable the needle-sliders to follow a needle which is possibly excluded or transferred to the axially neighboring cylinder, and also enable the latch of the needle to be protected during rotation of the cylinder.

The purpose of the invention is to govern the selection of needles in a circular knitting machine by means of one single system of actuators, whereby the system is preferably electromechanical and electrical and cooperates with a set of pressure cams for processing jacquard designs and with fixed cams for processing with purl stitches and for forming the heel (and toe) with alternating motion.

The invention therefore provides jacquard designs and governs the transfer of the needle themselves from one cylinder to the other so as to produce special ribbed or purl effects or for other processing.

Various other knitting processes can also be carried out with this invention owing to the presence on the cam jacket of suitable fixed and movable cams cooperating separately with needle-sliders which in their turn cooperate with a system of needle-jacks activated directly by outside selection acuators, which are preferably of an electromagnetic type and are preferably governed electronically.

According to the invention the processing of purl stitches and the formation of the toe or heel of the hose are performed by means of cooperation between fixed cams and the selection actuators located outside the needle cylinders, whereas the processing of jacquard designs is obtained by cooperation between the actuators and pressure cams which can be cut in when required, whereby the cams and the actuators act on the various needle jack selectors in a coordinated manner.

Moreover, according to the invention a small butt located in the upper part of each swinging selector and working in the zone of the toe or heel of the hose forms the toe and heel of the hose, the toe and heel being produced with alternating motion. The butt cooperates with suitable fixed cams which are on the jacket and which cooperate in their turn with the selection actuators in the zone.

The invention eliminates the memory path and the need to disengage the needle-sliders from their own needle-jack selectors, which remain engaged with the needle-sliders during transfer of the needles from the lower cylinder to the upper one.

Furthermore, the invention requires only one path for the exclusion and protection of upper cylinder needles, the path being located above and connected to the working path of the needles.

This invention therefore displays a procedure for the knitting of hose with toe and heel in a circular machine having more than one feed and preferably a double needle cylinder. The procedure is characterised by the facts that all the needles are brought to an upper path during the formation of the toe and heel with alternating motion, and that at each oscillation of the cylinder only those needles which have been selected to knit the course relative to the oscillation are brought back to work from the upper path towards a lower working path, whereby the selection is brought about by cooperation between fixed radial cams located so as to correspond with the main feed and suitable selection actuators, the procedure being also characterised by the fact that selection for jacquard designs takes place upwards from a lower path to the upper path by means of cooperation between appropriate selection actuators and movable radial cams located so as to correspond with each feed.

In the procedure of the invention the upper path serves to take the needles of the lower cylinder out of work and also to protect the upper cylinder needles.

The invention is also embodied with a circular hose machine which has at least one feed and preferably two cylinders and which is equipped to form the toe and heel with an alternating motion, whereby at least one cylinder having grooves for the needles and needle jacks comprises a jacket with cams for the performance of the ascent and descent of the needles and needle jacks, the machine includes in combination: in each groove, a needle-slider, a needle jack to move the needle-slider, and a swinging selector pivoted on the needle jack and cooperating at its lower end with a lower selector pivoting at its end on the cylinder, a plurality of cams causing descent and plurality of cams causing ascent which cooperate with the swinging selectors, a plurality of movable radial cams able to cooperate with the swinging selectors, a plurality of fixed radical cams which also can cooperate with the swinging selectors, and a plurality of selection actuators positioned in groups and able to act on the lower selectors, whereby the actuators perform the selection of needles with the cooperation of the radical cams.

Other details and features of the invention will stand out from the description given below by way of non-limitative example and with reference to the accompanying drawings, in which.

Figure 1:
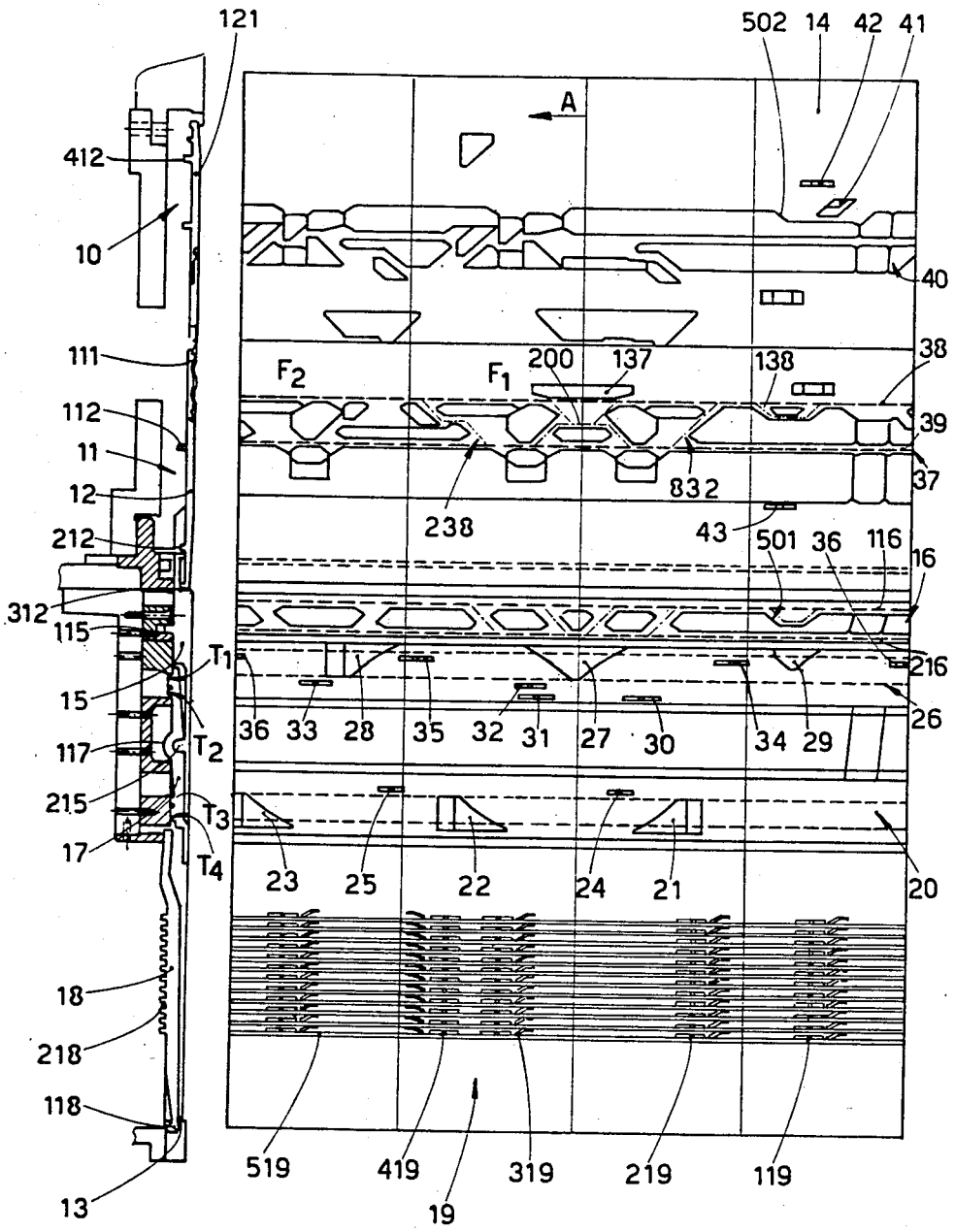
FIG. 1 shows a plan view of the inner development of the jacket of the cams with a partial section of the needle cylinders.

With reference to FIG. 1, the circular hose machine has an upper cylinder 10 and a lower cylinder 11, and each cylinder 10,11 is equipped with a plurality of needle-sliders 12 sliding in a corresponding plurality of guiding and lodgement grooves 13. The needle-sliders 12 bear needles 111 suitable to be transferred from one cylinder to the other.

Each needle-slider 12 comprises an upper butt 112 extending radially and able to cooperate with paths machined at appropriate levels in the jacket 14 of the cams and also comprises two lower butts 212,312 able to engage and take the butt 115 of a pulling jack 15 located below said needle-slider 12.

The pulling jack 15 has in its upper part a butt 115 able to cooperate with a guide groove 16 having an upper path 116 and lower path 216 connected together with a plurality of intermediate paths.

Moreover, the pulling jack 15 comprises a protrusion 215 on which a selector 17 is provided at an intermediate point 117 and swings around said pivoting point 117.

According to the invention the needle-slider 12, pulling jack 15 and swinging selector 17 always remain substantially engaged with each other in their vertical movements within the relative groove 13 during the working cycle and cooperate with each other in excluding and engaging the needles 111 at each feed.

According to the invention the swinging selector 17 comprises in its upper part a higher butt $T_1$ and lower butt $T_2$ and in its lower part a higher butt $T_3$ and lower butt $T_4$.

As will be described hereinafter, the butts cooperate with their respective radial and vertical cams located at appropriate heights on the jacket 14.

Each swinging selector 17 cooperates at least temporarily with a lower selector 18 able to pivot on its own lower end 118.

The lower selector 18 comprises a plurality of butts 218 located at various heights and able to cooperate with a plurality of selector actuator means 19, which are of a substantially known and preferably electromagnetic type and are connected to appropriate electronic programming means or other like means.

The selection actuators are positioned radially and below the jacket of the cams.

According to the invention the jacket 14 comprises, in its lower part so as to correspond with the working zones of the swinging selectors 17, a lower circuit 20 having a plurality of vertical ascent cams 21,22,23 and also two radial cams 24 and 25 at a higher level.

The vertical cams 21,22,23 cooperate with the lowest butts $T_4$, whereas the radial cams 24,25 cooperate with the upper butts $T_3$ of the lower part of the swinging selectors 17.

The ascent cams 22,23 are located immediately downstream from the respective feeds $F_1$ and $F_2$ in the direction of rotation of the needles, which is in the direction of the arrow A in FIG. 1, whereas the ascent cam 21 is located upstream from the main feed $F_1$ and is used during the alternating motion.

The ascent cam 21 has a profile rising in the opposite direction to the normal working direction (arrow A) and is used only during formation of the toe or heel of the hose.

The cams 22,23 instead, have a profile rising in the direction of the arrow A.

The radial cams 24,25 are located downstream from the ascent cams 21,22 respectively.

The jacket 14 has a circuit with cams located so as to correspond with the upper pair of butts $T_1$ and $T_2$ and consisting of a plurality of vertical descent cams 27,28,29 and a plurality of pairs of radial cams 30,31,32,33 and 34,35 the pairs of radial cams being positioned at differentiated levels.

The cams 32,33 can be engaged individually as wished by the command of the selection system of the machine, whereas the other cams 30,31,34,35,36 are fixed cams.

The descent cam 27 has a double symmetrical profile and is located just upstream from the main feed $F_1$, whereas the descent cam 28 has one single profile descending in the direction of the arrow A and is located upstream from the other feed $F_2$.

The descent cam 29 is situated upstream from the cam 27 and cooperates with the selection actuators for face stitches 119, whereby the actuators 119 are located upstream from said cam 29 and start working only during the processing of purl and rib stitches.

Moreover, according to the invention an upper circuit 37 is on the jacket and is provided with working cams acting on the butt 112 of the needle-slider 12 and comprises an upper path 38 for the exclusion and protection of upper cylinder needles and a lower path 39 for jacquard designs for the floating needles, whereby the two paths 38,39 are connected together by intermediate working paths 200 in the zones of the feeds $F_1$ and $F_2$.

Furthermore, the upper path 38 comprises a small path 138 for transferring needles, the path 138 being located so as to correspond with the purl-stitch descent cam 29.

The jacket of the upper cylinder 10 has a traditional circuit 40 equipped with a plurality of cams, including the vertical cam 41 to transfer needles, the cam 502 and the radial cam 42, whereby the cams 41,42 start working during processing with purl stitches, as will be described hereinafter.

A radial cam 43 is in the circuit 37 in the middle part of the jacket with the purl stitch zone and is located radially just downstream from the purl-stitch descent cam 29, whereby said radial cam 43 acts on the butt 112 of the needle-slider 12 during processing with purl and rib stitches. Cam 43 acting on the butt 212 makes the slider 12 turn over leaving the needle attached to the upper slider 121.

In FIG. 1 the selection actuators 19 comprise three groups of actuators, namely 119 for purl stitch processing 219,419 for producing the toe and heel of the hose with alterating motion and 319,519 for processing jacquard designs, and each group of actuators cooperates with its respective radical cams.

Referring to FIG. 1, let us now see how the invention works when processing hose with jacqard designs.

At the entry of the main feed $F_1$ the needle-sliders 12 which have been selected beforehand and moved upwardly and which have to knit the hose are located in the working path 38, whereas the needle-sliders which do not have to knit at feed $F_1$ are in a lower floating position where their butts 112 slide in the jacquard path 39.

To be more exact, the butts 115 of the respective pulling jacks 15 corresponding with the needle-sliders 12 at work slide in the path 116, and the butts $T_1$ of the swinging selectors 17 are situated at the same height as the radial cams 34,35,36 and are thrust radially into the cylinder 11, whereas the lower butts $T_4$ are positioned at the same height as the radial cams 24,25 and protrude radially from the cylinder 11 so that they can cooperate possibly with the cam 27.

On the other hand, the butts 115 corresponding with the floating needle-sliders 12 run in the path 216, whereas the uppermost butts $T_1$ of the swinging selectors 17 are situated at the same height as the radial cams 32,33, the butts $T_1$ being in a protruding position in relation to the cylinder 11.

When the selector 17 has been raised by one of the cams 22 or 23 and reaches the cams 29, 25 or 27, all the corresponding slides 12 are taken into the jacquard path after having formed the stitches; the relative swinging selectors 17 are knocked at the same time by the vertical descent cam 27 acting on the butts $T_1$ thereof.

The butts $T_1$ are now situated so as to correspond with the movable radial cam 32, which pushes them towards the inside of the cylinder 11.

The rotation of the swinging selectors 17 around their pivoting point 117 brings the butts 218 of the relative lower selectors 18 into a radially protruding position so that the lower selectors 18 can be affected by the relative selection actuators 319 located in a group and acting individually on each lower selector 18.

The selection actuators 319 generate an inward radial thrust against the selected lower selectors 18. The radial thrust is transmitted to the lower end of the respective swinging selectors 17, which rotate around their pivot 117 and withdraw their own butts $T_4$ from the ascent cam 22, thus hindering the departure of the respective needle-sliders 12 from the jacquard path 39.

The swinging selectors 17 relative to the lower selectors 18 not affected by the action of the actuators 319 are thrust upwardly by the ascent cam 22, the respective needle-sliders 12 being brought thereby into the upper path 38.

The cam 25 knocks the butts $T_4$ of all the swinging selectors 17 relating to the needle-sliders 12 which have to make a stitch since the action puts the upper butts $T_1$ in contact with the descent cam 28. The upper butts $T_1$ downstream from the descent cam 28 are knocked into the cylinder by the movable cam 33 whenever the latter has been engaged in readiness for the next selection by the actuator group 519 located upstream from the main feed $F_1$.

It is clear that cooperation between the actuator groups 319,519 and movable cams 32,33 and 24,25 respectively enables a wide range of jacquard designs to be produced.

Figure 5:
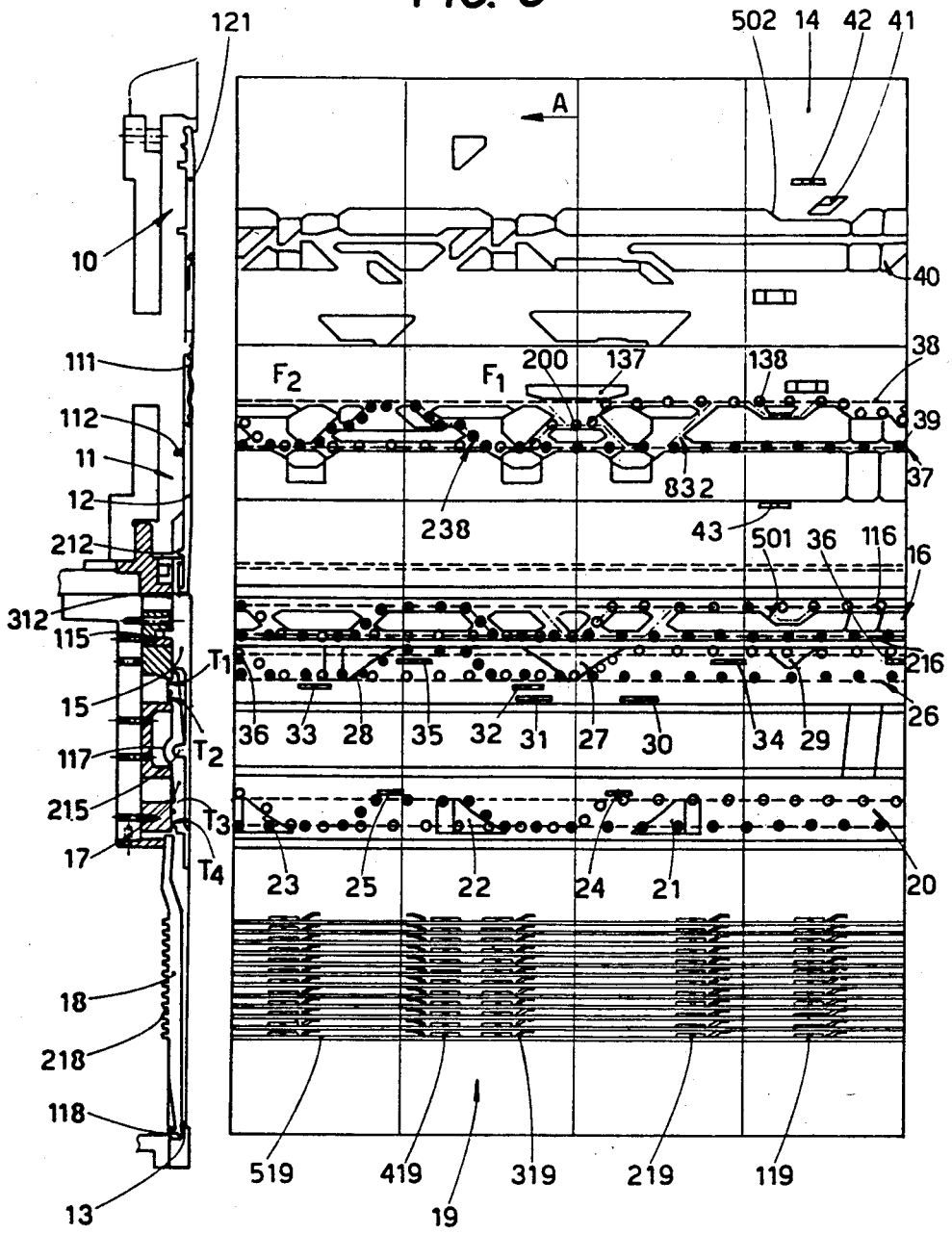
FIG. 5 shows the development of the jacket of cams for Jacquard design knitting.

For processing Jacquard designs, the cams 24, 32, 25 and 33 start working (in the meaning that they are brought against the corresponding butts of the selector 17) as shown in FIG. 5. The set of selector levers 319 act so that the needles marked with the circle sign are not raised by the cam 22 and do not makes stitches in the second feed. On the contrary, the needles shown by solid dots ascend on the cam 22 and make stitches in the second feed and are united with the circled needles owing to the cam 28. All the needles are readied by the cam 33 for the next selection by the group 519; the cam 23 raises the circle needles which have not been cancelled by the group 519 and which proceed to make stitches in the first feed. On the contrary, the solid dot needles will float in the first feed.

It is known that, in processing with purl stitches, the working needle has to be transferred from one cylinder to the other.

According to the invention the transfer of needles from one cylinder to the other is brought about mainly by cooperation between the selection actuator group 119, the fixed radial cam 36, the ascent slope 501 and the descent cam 29 able to act on the uppermost butt $T_1$ of the swinging selectors 17, together with the help of the radial cam 43 cooperating with the lower butt 212 of the needle-slider 12 of the lower cylinder and the transfer cam 41 and radial cam 42 of the upper cylinder 10 acting on the needle-sliders 121 of the upper cylinder.

Before it reaches the actuator group 119, the radial cam 36 knocks all the uppermost butts $T_1$ of the swinging selectors 17 towards the inside of the cylinder and in this way thrusts the butts 218 of the lower selectors 18 outwards.

The actuator group 119 selects the lower selectors 18 of the needles of the lower cylinder which have to be transferred to the upper cylinder. The transfer cam 41 of the upper cylinder now lowers all the upper needle-sliders 121.

The needle-sliders 12 of the lower cylinder which have just been selected are pulled downwards with their respective needles along the secondary path 138 by the action of the descent cam 29 acting on the butts $T_1$ of the respective swinging selectors 17.

The needle-sliders 12 which have not been selected go on sliding on the working path 38 and are ready to transfer their own needles to the upper needle-sliders 121. The transfer takes place when the butts 212 of the raised needle-sliders meet the radial cam 43 and are transferred by the profile 502.

The swinging of the needle-sliders 121 caused by the fixed cam 42 enables the needles to remain in the lower cylinder. The cam 42 acts on the higher butt 412 of the slider 121. The needles which stay in the lower cylinder are those of which the jacks 17 are lowered by the cam 29.

After the transfer of the needles, the needle-sliders 12 which have kept their own needles are made to ascend along the slope 138 up to the upper path 38.

Figure 6:
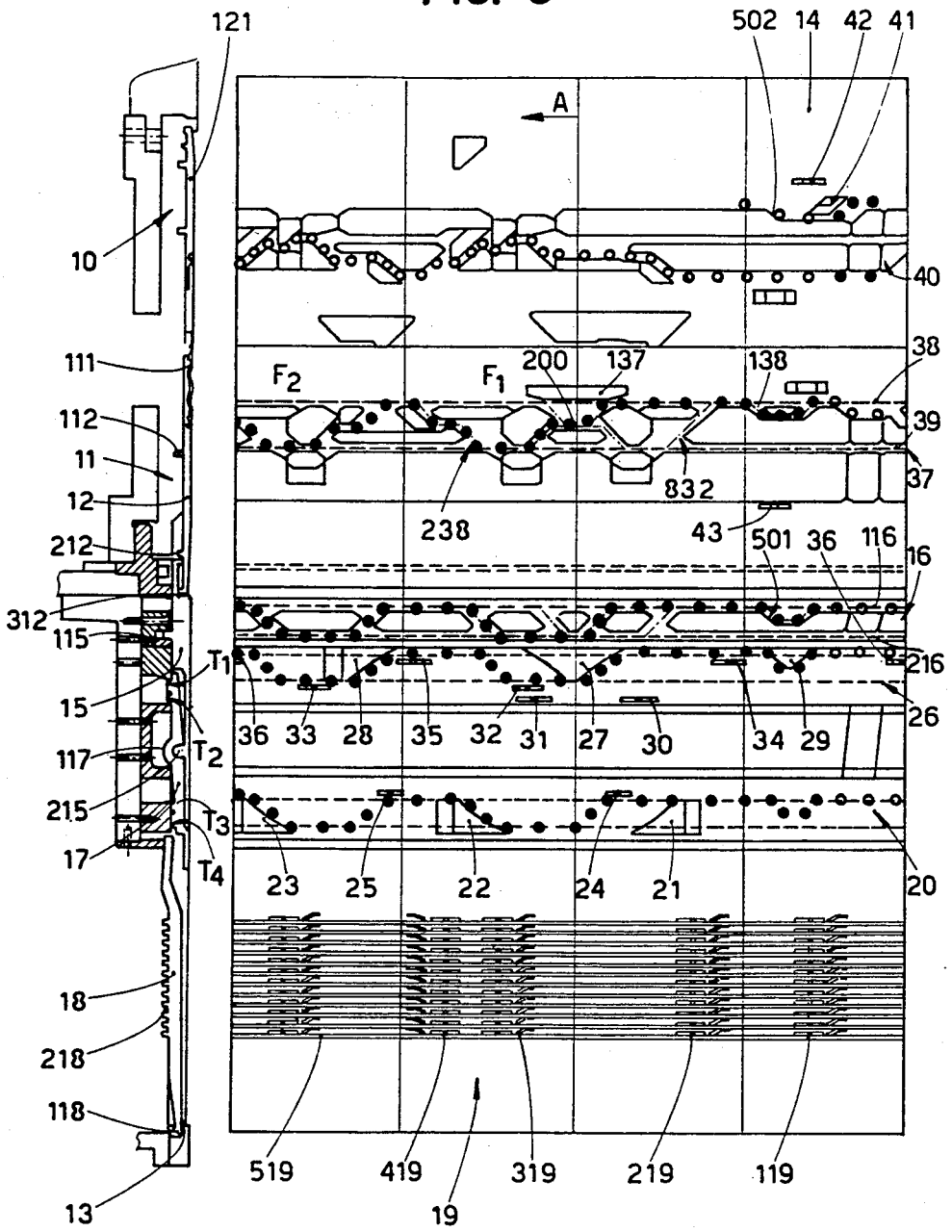
FIG. 6 shows the development of the jacket of cams for links or plain/purl transfer knitting.

FIG. 6 shows the paths which the sliders and selectors follow in the case of a needle which is transferred from the upper to the lower cylinder. Again, the solid dots represent sliders with needles and the circles represent sliders without needles.

Some of the needles of the lower cylinder 11 are excluded during production of the toe and heel of the hose and the respective needle-sliders 12 are taken into the exclusion and working path 38. The needle-sliders 121 of the upper cylinder 10 are also excluded. All the feeds are deactivated except the main feed $F_1$.

The toe or heel of the hose is produced with alternating motion in such a way as to exclude or include, in each rotation, a number of needles to suit the portion of the toe or heel being formed.

Exclusion and inclusion of needles are determined by the selection actuator groups 219,419 which are respectively located to the right and left of the main feed $F_1$ and substantially symmetrically in relation to the two-way cam 27. To be more exact, all the selectors are put out of work, namely the needle-slider 12 in the exclusion and working path 38, the pulling jacks 15 in the path 116 and the swinging selectors 17 in the raised position where their butts $T_1$ are at the same height as the cams 34,35,36.

During the first swing in the direction of the arrow A butts $T_1$ remain in a radially outward position prior to arrival at cam 34, engage and are lowered by cam 29. Thereafter the selectors 17 are raised by the jacks 15 through cam 501. The cam 34 knocks all the butts $T_1$ of the selectors 17 into the cylinder 11. Soon afterwards the selection group 219 begins working and makes the butts $T_1$ of the swinging selectors 17 protrude once again. The cam 24 remains out of work during the reciprocating motion processing on the heel and toe. During that time the selectors 219, 419 are in operation.

The descent cam 27 acts on the butts $T_1$ and draws all the selectors 17 which have just been selected, downwards together with the respective pulling jacks 15 and the needle-sliders 12, thus enabling the needles to pick up the thread and make stitches therewith.

The fixed cam 31, which is now located at the height of the lower $T_2$ of the upper two butts, starts working so as to bring the needle-sliders 12 once more into the working path. The cam 31 knocks the butts $T_2$ of the previously selected selector 17 into the cylinder. The butts $T_2$ are comprised only in the swinging selector 17 which work on the cylinder when the heel is being made.

The ascent cam 22 makes all the swinging selectors 17 rise. In the meantime the needle-sliders at work (path 200) rise along the intermediate path 238 into the exclusion and protection path 38.

The cycle described earlier is repeated during the return oscillation, since the cam 35 knocks the butts $T_1$ of the swinging selectors 17, the actuator group 419 selects the needles which have to work, and the two-way cam 27 pulls downwardly all the swinging selectors 17 just selected together with the respective needle-sliders 12, which now starting knitting, along the working path. The cam 30 acts on the lower butts $T_2$ of the upper butts and thereafter causes the lowest butts $T_4$ to be engaged with the ascent cam 21 and also makes the respective needle-sliders 12 rise into the exclusion and protection path 38 along the intermediate path 832. Lastly, the cam 34 knocks all the butts $T_1$ of the swinging selectors 17 before the next oscillation in direction A.

Figure 4:
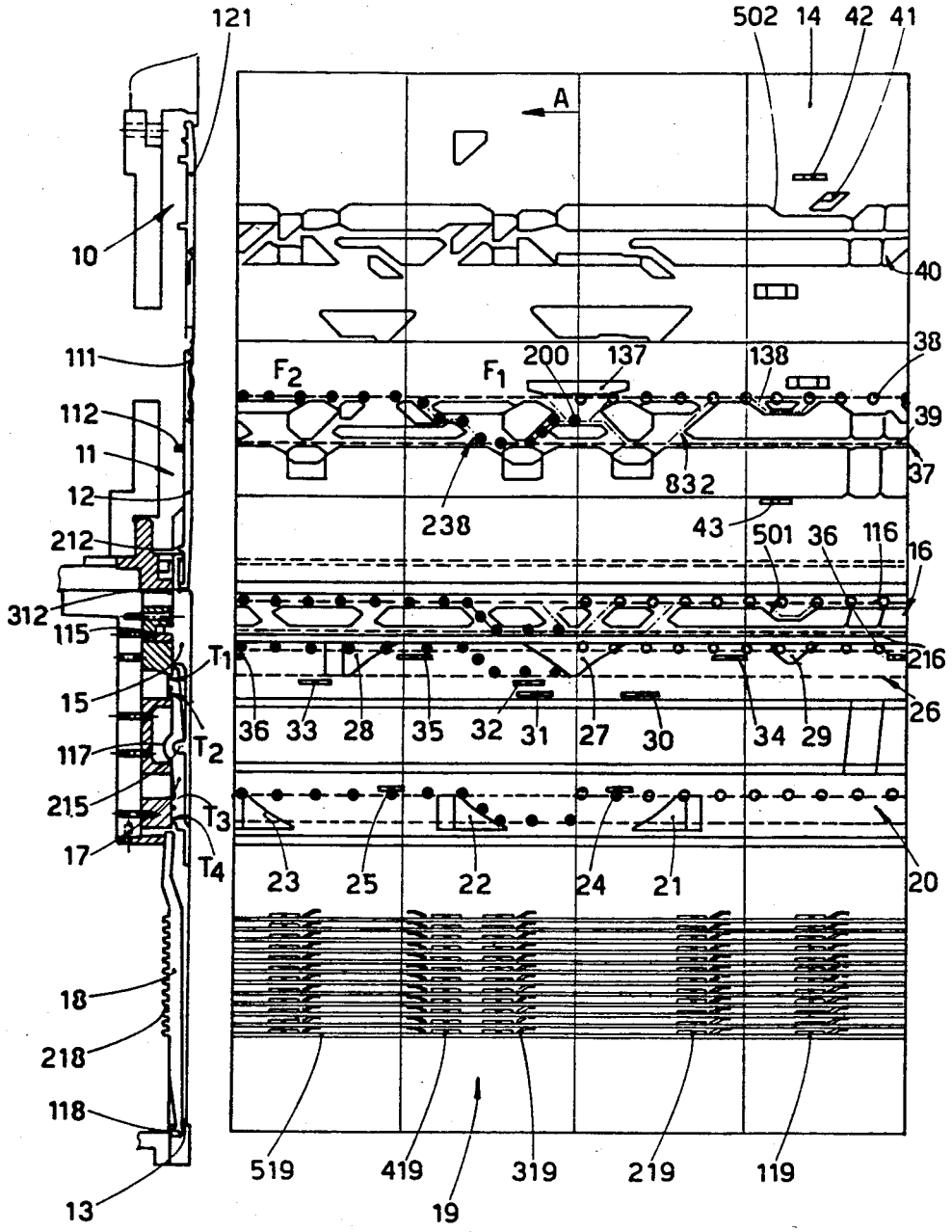
FIG. 4 shows the development of the jacket of cams for knitting a heel portion.

In obtaining the heel, the needles shown in circles are disengaged during the semi-oscillation from right to left and stay at the highest level (see FIG. 4). Instead, the needles shown in solid dots are the ones which work; their descent from the disengaged level to the working level is determined by the action of the selector levers of the group 219 which resets the selector 17 that had had earlier its upper part sunk in the groove of the cylinder of the cam 34. This action makes possible the descent that occurs physically due to the cam 27. The cams 31 and 32 are also at work. The cams 27, 22, 21, 30, 31, 34 and 35 are stationary for the whole cycle of manufacture of the hose; the selection for the decreases and increases is done by the groups of selector levers 219 and 419.

Figure 2:
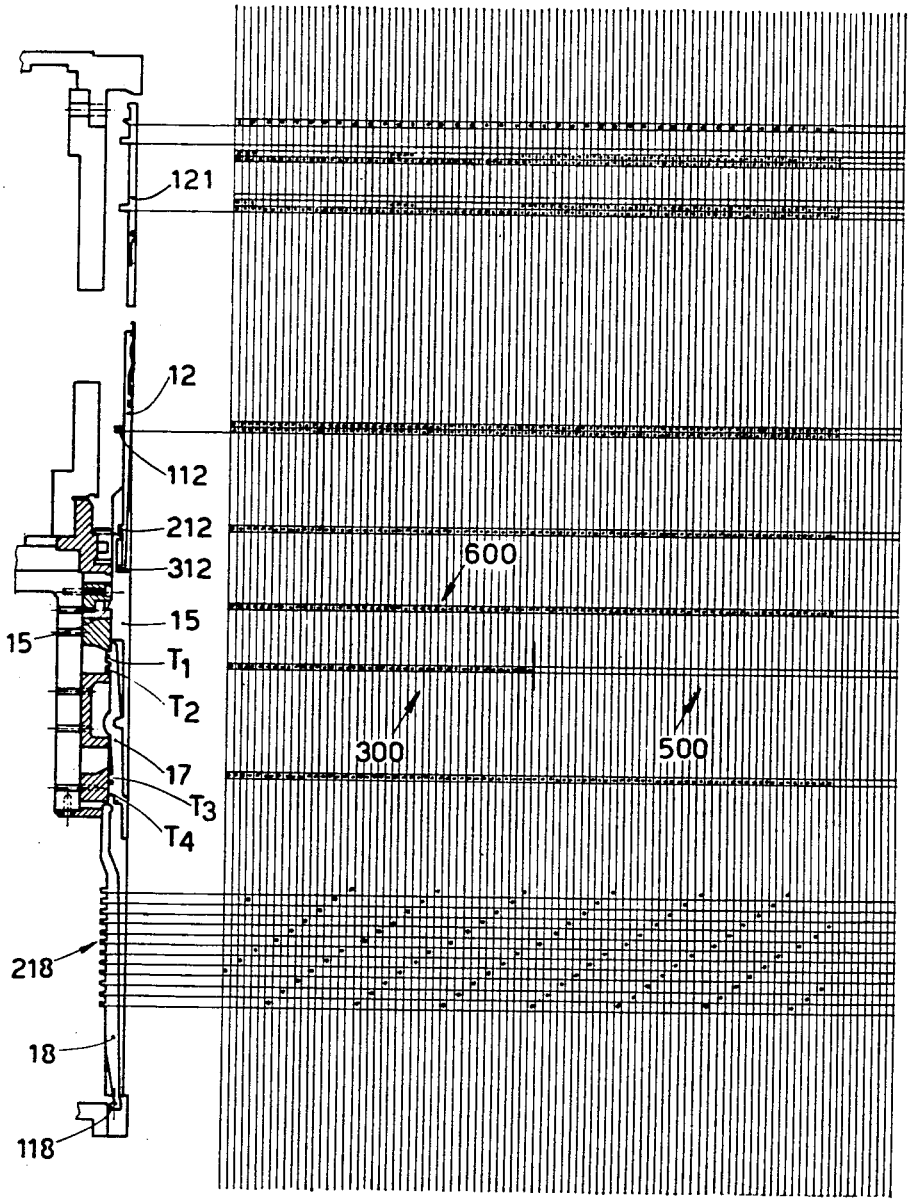
FIG. 2 shows the levels and lay-out of the butts of the selectors and needle jacks.
Figure 3:
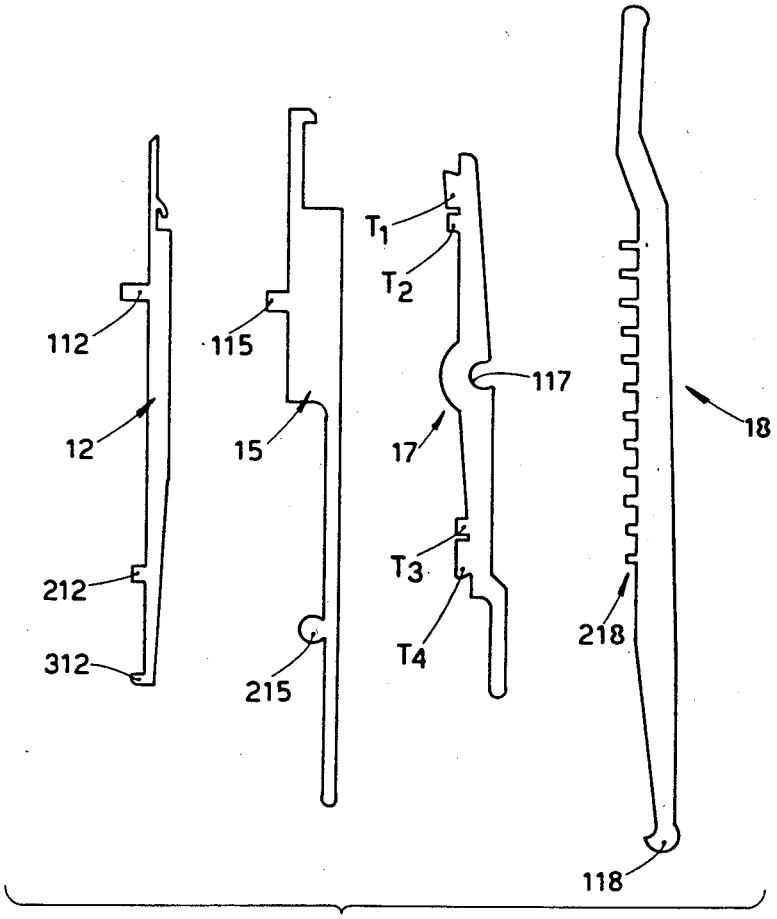
FIG. 3 shows the needle sliders, jacks and selectors of the invention.

FIG. 2 shows diagrammatically the movements of the various needle-sliders 12, needle jacks 15 and selectors 17 and 18 and the lay-out of the respective control butts.

It can be seen clearly that only the swinging selectors 17 working in the arc of the heel 300 comprise the butt $T_2$, whereas those in the arc 500 are substantially without the butts. The level 600 shows that all the jacks 15 have the butt during processing with purl stitches.

A preferential embodiment of the invention, but other variants are possible for a person skilled in this field without departing thereby from the scope of the invention has been described.

We claim:

1. Process for knitting hose with toe and heel in a circular machine having an upper and lower cylinder with radial cams, selection actuators, needles, more than one feed and two needle cylinders, comprising oscillating said cylinders, bringing all the needles to an upper path during production of the toe and heel with alternating motion by means of said cams, lowering at each oscillation of the cylinders those needles alone which have been selected to knit the course relative to said oscillation from said upper path towards a lower working path by cooperation between fixed radial cams located so as to correspond with the main feed and appropriate selection actuators, wherein said upper path serves to exclude the needles of the lower cylinder from knitting and to protect the needles in the upper cylinder.

2. The process for knitting hose as in claim 1 including raising needles from a lower path to said upper path by means of selection actuators and movable radial cams to form jacquard designs.

3. Circular machine for knitting, which has at least one feed and is equipped to produce a toe and heel with alternating motion, comprising at least one cylinder with a plurality of grooves for needles and jacks, each groove including a needle, a needle-slider, a jack for pulling the needle-slider, a swinging selector pivoting on said pulling jack, a lower selector pivotable at its end on the cylinder cooperating with the lower end of said swinging selector, said machine further includes a jacket with cams to perform the ascent and descent of the needles and jacks, a plurality of descent cams and a plurality of ascent cams cooperating with said swinging selectors, a plurality of movable radial cams able to cooperate with said swinging selectors, a plurality of fixed radial cams also able to cooperate with said swinging selectors, and a plurality of selection actuators positioned in groups and able to act on the lower selectors, whereby said actuators select the needles with the cooperation of the movable and fixed radial cams.

4. The machine as in claim 3, wherein said swinging selectors pre-arranged to work in the part relating to the toe and heel each comprise at their lower end a butt able to cooperate with the ascent cams or with the movable radial cams, and in their upper part two butts, whereby the uppermost butt can cooperate with the descent cams or with the movable radial cams, whereas the lower butt can cooperate with the fixed cams.

5. The machine as in claim 3 or claim 4, wherein each of said swinging selectors has an upper part and a lower part, and said swinging selectors which work in relation to the instep include only higher butts on said upper part where selectors not working in relation to the instep include higher and lower butts on said upper part.

6. The machine as in claim 3, wherein a first group of said selection actuators are positioned at each side of the main feed so as to carry out a downward selection of needles to produce the toe or heel.

7. The machine as in claim 3 or claim 4, including a second group of said selection actuators for actuating an upward selection of needle-sliders for jacquard designs for the nearest feed is located so as to correspond with each feed.

8. The machine as in claim 3, wherein a third group of said selection actuators to select the needles to be transferred are situated so as to correspond with a descent cam,, and an ascent cam cooperates with the pulling needle jacks not selected, the purpose of said cooperation being to bring said needle jacks and their respective needle-sliders into a working path.

* * * * *